United States Patent [19]

Rana et al.

[11] Patent Number: 4,461,657

[45] Date of Patent: Jul. 24, 1984

[54] HIGH STRENGTH STEEL AND GAS STORAGE CYLINDER MANUFACTURED THEREOF

[75] Inventors: Mahendrasinh D. Rana, North Tonawanda; Ronald J. Selines, North Salem, both of N.Y.

[73] Assignee: Union Carbide Corporation, Danbury, Conn.

[21] Appl. No.: 496,078

[22] Filed: May 19, 1983

[51] Int. Cl.[3] ..... C22C 29/00

[52] U.S. Cl. ..... 148/36; 75/124; 75/125; 75/126 E; 75/126 G; 75/126 J

[58] Field of Search ..... 75/124 B, 126 C, 126 E, 75/126 G, 126 J, 125; 148/36, 12 F

[56] References Cited

U.S. PATENT DOCUMENTS

| | | | |
|---|---|---|---|
| 2,234,047 | 3/1941 | Frevert | 75/126 |
| 2,244,881 | 6/1941 | Kanter | 148/31 |
| 2,250,505 | 7/1941 | Selmi et al. | 75/126 |
| 2,375,954 | 5/1945 | Selmi et al. | 75/126 |
| 2,395,687 | 2/1946 | Selmi et al. | 75/126 |
| 2,447,089 | 8/1948 | Payson | 75/123 |
| 2,586,041 | 2/1952 | Hodge et al. | 75/128 |
| 2,861,908 | 11/1958 | Mickelson et al. | 148/31 |
| 2,863,763 | 12/1958 | Rosenberg et al. | 75/128 |
| 3,068,095 | 12/1962 | Anthony et al. | 75/126 |
| 3,092,491 | 6/1963 | Payson et al. | 75/126 |
| 3,152,020 | 10/1964 | Gross | 148/36 |
| 3,155,500 | 11/1964 | Anthony et al. | 75/126 |
| 3,254,991 | 6/1966 | Shimmin et al. | 75/128 |
| 3,331,682 | 7/1967 | Susaki et al. | 75/126 |
| 3,574,602 | 4/1971 | Gondo et al. | 75/126 |
| 3,929,428 | 12/1975 | Nishi et al. | 75/126 |
| 3,992,231 | 11/1976 | Timmons | 148/143 |
| 4,226,645 | 10/1980 | Waid et al. | 148/2 |
| 4,354,882 | 10/1982 | Greer | 148/12 F |

FOREIGN PATENT DOCUMENTS

| | | | |
|---|---|---|---|
| 55-141546 | 11/1980 | Japan | 148/36 |
| 0694557 | 10/1979 | U.S.S.R. | 75/124 B |

OTHER PUBLICATIONS

DOT Specification 3AA, Paragraph 178.37, pp. 204–206.

Lukens Fineline Steels, Lukens Steel Company, Coatesville, Pa.

*Primary Examiner*—L. Dewayne Rutledge
*Assistant Examiner*—Debbie Yee
*Attorney, Agent, or Firm*—Stanley Ktorides

[57] ABSTRACT

A precisely defined steel alloy particularly suited to gas storage cylinder manufacture, and a gas storage cylinder manufactured thereof which exhibits remarkably improved performance over conventional gas storage cylinders.

11 Claims, 4 Drawing Figures

HIGH STRENGTH STEEL AND GAS STORAGE CYLINDER MANUFACTURED THEREOF

TECHNICAL FIELD

This invention relates to gas storage cylinders and the steel of which they are made and more particularly to a novel gas storage cylinder which exhibits improved cylinder efficiency, ultimate tensile strength, fracture toughness, and fire resistance over gas storage cylinders which are currently available.

BACKGROUND ART

Gases, such as oxygen, nitrogen and argon, are delivered to a use point in a number of ways. When the use of such gases requires a relatively small quantity of gas at one time, such as in metal cutting, welding, blanketing or metal fabrication operations, the gas is typically delivered to the use point and stored there in a gas storage cylinder.

Most cylinders in use in the United States today are manufactured in accordance with U.S. Department of Transportation Specification 3AA which requires that gas cylinders be constructed of designated steels, including 4130X steel. Cylinders conforming to this Specification 3AA are considered safe and exhibit good fracture toughness at the allowed tensile strengths.

With increasing transportation costs, there has arisen a need for an improved gas storage cylinder. In particular there has arisen a need for a gas storage cylinder which has much better cylinder efficiency than that of Specification 3AA. However, any such increase in cylinder efficiency cannot be at the expense of cylinder fracture toughness at the usable tensile strengths.

Since tensile strength and fracture toughness are, to a large extent, characteristic of the material of which the cylinder is made, it would be highly desirable to have a material to construct a gas storage cylinder which has improved cylinder efficiency while also having improved tensile strength and fracture toughness.

It is therefore an object of this invention to provide a steel and a gas storage cylinder manufactured thereof which has increased cylinder efficiency over that of conventional gas storage cylinders.

It is another object of this invention to provide a steel and a gas storage cylinder manufactured thereof which has increased ultimate tensile strength over that of conventional gas storage cylinders.

It is yet another object of this invention to provide a steel and a gas storage cylinder manufactured thereof which has increased temper resistance over that of conventional gas storage cylinders.

It is a further object of this invention to provide a steel and a gas cylinder manufactured thereof which has increased high temperature strength over that of conventional gas storage cylinders.

It is a still further object of this invention to provide a steel and a gas storage cylinder manufactured thereof which has increased fracture toughness over that of conventional gas storage cylinders.

SUMMARY OF THE INVENTION

The above and other objects which will become apparent to one skilled in the art upon a reading of this disclosure are attained by the present invention one aspect of which comprises:

A low alloy steel consisting essentially of:

(a) from 0.28 to 0.50 weight percent carbon;
(b) from 0.6 to 0.9 weight percent manganese;
(c) from 0.15 to 0.35 weight percent silicon;
(d) from 0.8 to 1.1 weight percent chromium;
(e) from 0.15 to 0.25 weight percent molybdenum;
(f) from 0.005 to 0.05 weight percent aluminum;
(g) from 0.04 to 0.10 weight percent vanadium;
(h) not more than 0.040 weight percent phosphorus;
(i) not more than 0.015 weight percent sulfur; and
(j) the remainder of iron.

Another aspect of this invention comprises:

In a gas storage cylinder exhibiting leak-before-break behavior, the improvement, whereby increased cylinder efficiency, ultimate tensile strength, fracture toughness and fire resistance are attained, comprising a cylinder shell of a low alloy steel consisting essentially of:

(a) from 0.28 to 0.50 weight percent carbon;
(b) from 0.6 to 0.9 weight percent manganese;
(c) from 0.15 to 0.35 weight percent silicon;
(d) from 0.8 to 1.1 weight percent chromium;
(e) from 0.15 to 0.25 weight percent molybdenum
(f) from 0.005 to 0.05 weight percent aluminum;
(g) from 0.04 to 0.10 weight percent vanadium;
(h) not more than 0.040 weight percent phosphorus;
(i) not more than 0.015 weight percent sulfur; and
(j) the remainder of iron.

A further aspect of this invention comprises:

A gas storage cylinder exhibiting leak-before-break behavior and having improved cylinder efficiency, ultimate tensile strength, fracture toughness and fire resistance comprising a cylinder shell of a low alloy steel comprised of:

(a) from 0.28 to 0.50 weight percent carbon;
(b) element(s) from the group comprising manganese, silicon, chromium, molybdenum, nickel, tungsten, vanadium and boron in an amount sufficient to obtain an essentially martensitic structure throughout the steel after a one side oil or polymer solution quench;
(c) element(s) from the group comprising manganese, silicon, chromium, molybdenum and vanadium in an amount sufficient to require a tempering temperature of at least about 1000° F. to achieve an ultimate tensile strength of at least 150 thousands of pounds per square inch;
(d) not more than 0.015 weight percent sulfur;
(e) not more than 0.040 weight percent phosphorus; and
(f) the remainder of iron.

As used herein the term "cylinder" means any vessel for the storage of gas at pressure and is not intended to be limited to vessels having a geometrically cylindrical configuration.

As used herein the term "leak-before-break" behavior means the capability of a gas storage cylinder to fail gradually rather than suddenly. A cylinder's leak-before-break capability is determined in accord with established methods, as described, for example, in *Fracture and Fatigue Control in Structures—Application of Fracture Mechanisms,* S. T. Rolfe and J. M. Barsom, Prentice Hall Inc., Englewood Cliffs, N.J., 1977. Section 13.6, "Leak-Before-Break".

As used herein the term "cylinder efficiency" means the ratio of the maximum volume of stored gas, calculated at standard conditions, to cylinder weight.

As used herein the term "ultimate tensile strength" means the maximum stress that the material can sustain without failure.

As used herein, the term "hardenability" refers to the capability of producing a fully martensitic steel microstructure by a heat treatment comprised of a solutionizing or austenitizing step followed by quenching in a cooling medium such as oil or a synthetic polymer based quenchant. Hardenability can be measured by a Jominy end quench test as described in *The Hardenability of Steels*, C. A. Siebert, D. U. Doane, and D. H. Breen, American Society for Metals, Metals Park, Ohio, 1977.

As used herein, the term "inclusion" means non-metallic phases found in all steels comprised principally of oxide and sulfide types.

As used herein, the term "temper resistance" means the ability of a steel having a quenched martensitic structure to resist softening upon exposure to elevated temperatures.

As used herein the term "fracture toughness $K_{1c}$" means a measure of the resistance of a material to extension of a sharp crack or flaw, as described, for example, in ASTM E616-81. Fracture toughness is measured by the standardized method described in ASTM E813-81.

As used herein, the term "hoop stress" means the circumferential stress present in the cylinder wall due to internal pressure.

As used herein, the term "Charpy impact strength" means a measure of the capability of a material to absorb energy during the propagation of a crack and is measured by the method described in ASTM E23-81.

As used herein, the term "fire resistance" means the ability of a cylinder to withstand exposure to high temperatures, as in a fire, so that the resultant increase in gas pressure is safely reduced by the safety relief device, such as a valve or disk, rather than by catastrophic failure of the cylinder due to insufficient high temperature strength.

DETAILED DESCRIPTION

Figure 1:
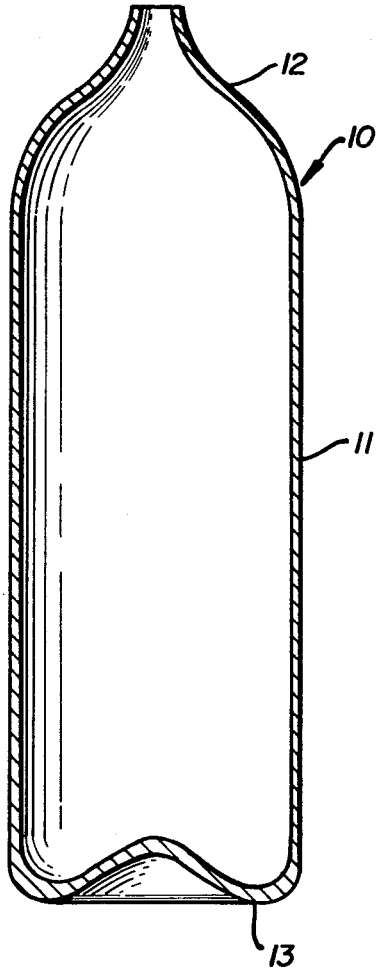
FIG. 1 is a simplified cross-sectional view of a gas storage cylinder of typical design.

Referring now to FIG. 1, gas storage cylinder 10 is composed of a shell comprising cylindrical midsection 11 having a relatively uniform sidewall thickness, bottom portion 13 which is somewhat thicker than the sidewall, and top portion 12 which forms a narrowed neck region to support a gas valve and regulator as might be required to fill and discharge gas from the cylinder. Bottom portion 13 is formed with an inward concave cross-section in order to be able to more suitably carry the internal pressure load of the cylinder. The cylinder itself is intended to stand upright on the bottom portion.

Cylinders such as is shown in FIG. 1 are extensively employed to store and transport many different gases from a manufacture or filling point to a use point. When the cylinder is empty of desired gas it is returned for refilling. In the course of this activity considerable wear may be sustained by the cylinder in the form of nicks, dents and welding arc burns. Such in-service wear compounds any flaws which may be present in the cylinder from the time of manufacture. These original or in-service generated flaws are aggravated by the repeated loading to pressure, discharge, reloading, etc. which a cylinder undergoes as well as exposure to corrosion inducing environments.

It is apparent that a cylinder must not fail catastrophically in spite of the abuse that it undergoes during normal service. A major contributor to the performance of gas storage cylinders is the material from which they are fabricated. It has been found that the steel alloy of this invention successfully addresses all of the problems that a gas storage cylinder will normally face while simultaneously exhibiting increased tensile strength and fracture toughness over that of conventional cylinders. The improved performance of the steel alloy of this invention results in less material required to fabricate a cylinder than that required to fabricate a conventional cylinder.

The steel alloy of this invention which is so perfectly suited to the specific problems which arise during cylinder use is, in addition to iron, composed of certain specific elements in certain precisely defined amounts. It is this precise definition of the alloy which makes this alloy so perfectly suited for use as a material for gas storage cylinder fabrication.

The steel alloy of this invention contains from 0.28 to 0.50 weight percent carbon, preferably from 0.30 to 0.42 weight percent, most preferably from 0.32 to 0.36 weight percent. Carbon is the single most important element affecting the hardness and tensile strength of a quench and tempered martensitic steel. A carbon content below about 0.28 weight percent will not be sufficient to provide a tensile strength in the desired range of 150 to 175 thousands of pounds per square inch (ksi) after tempering at a temperature greater than that possible for 4130X. Such elevated temperature tempering enables the steel alloy of this invention to have increased fire resistance over that of the heretofore commonly used cylinder steel. A carbon content above 0.50 weight percent can lead to quench cracking. Thus, the defined ranged for carbon concentration ensures sufficient carbon for the desired tensile strength after tempering while assuring a low enough carbon content and as-quenched hardness to preclude cracking during the cylinder quenching operation to produce martensite. Carbon, in the amount specified, also contributes to hardenability and helps to assure that the cylinder will have a fully martensitic structure.

It is important to assure a final structure which is essentially one of tempered martensite thoughout the cylinder wall thickness. Such a microstructure provides the highest fracture toughness at the strength levels of interest. Consequently, the steel alloy should contain a sufficient quantity of elements such as manganese, silicon, chromium, molybdenum, nickel, tungsten, vanadium, boron, and the like to assure adequate hardenability. The hardenability must be sufficient to provide at least about 90 percent martensite throughout the cylinder wall after a one side quench in either an oil or a synthetic polymer quenchant which simulates an oil quench, as stipulated by DOT specification 3AA. A more severe water quench is not recommended because of the greater likelihood of introducing quench cracks which would seriously degrade the structural integrity of the vessel. The carbon content has been limited to 0.50 weight percent to further reduce the possibility of such quench cracks. Those skilled in the art are familiar with the concept of determining the hardenability of a given steel by calculating an ideal critical diameter, or by conducting an end quench test, such as the Jominy test. Since the required level of hardenability depends on wall thickness, quenching medium and conditions, surface condition, cylinder size and temperature, and the like, such emperical methods must be employed to establish an acceptable level of hardenability and a suitable alloy content to provide such hardenability. Standard techniques, such as optical microscopy or X-ray diffraction may be used to establish martensite content.

Another material requirement which the alloy must satisfy is sufficient temper resistance. It is desirable to ensure a tempering temperature of at least about 1000° F. and preferably at least about 1100° F. The ability to temper to the 150 to 175 ksi strength range of interest using this range of tempering temperatures will further assure the development of an optimal quenched and fully tempered microstructure during heat treatment. Such a range of tempering temperatures also eliminates the possibility of compensating for failure to obtain a fully martensitic structure due to an inadequate quench by tempering at a low temperature. Such a heat treatment would result in lower fracture toughness and flaw tolerance.

Temper resistance and a sufficiently high tempering temperature range is also important because of possible cylinder exposure to elevated temperatures while in service. This may occur, for example, during a fire or due to inadvertent contact with welding and cutting torches. A high tempering temperature will minimize the degree of softening which would occur during such exposure. Furthermore, an alloy which allows a high tempering temperature to be used will also possess superior high temperature strength. This will increase the resistance of the cylinder to bulging and catastrophic failure due to exposure to such conditions during service. In order to meet these objectives, the steel alloy should have sufficient amounts of elements from the group of manganese, silicon, chromium, molybdenum, vanadium, and the like to allow a tempering temperature of at least 1000° F. to be employed. A minimum carbon content of 0.28 weight percent has also been specified for the same reason.

The steel alloy of this invention preferably contains from 0.6 to 0.9 weight percent manganese. This defined amount, in combination with the other specified elements and amounts of the invention, enables the steel alloy of this invention to have sufficient hardenability to provide a fully martensitic structure at quench rates which do not lead to quench cracking. This is important in order to obtain an optimum combination of strength and fracture toughness. The manganese also serves to tie up sulfur in the form of manganese sulfide inclusions rather than as iron sulfide. Iron sulfide is present in steels as thin films at prior austenite grain boundaries and is extremely detrimental to fracture toughness. The steel alloy of this invention generally has sulfur present as shape controlled calcium or rare earth containing oxy-sulfides. However, it is difficult to assure that absolutely all sulfur is incorporated into this type of inclusion. The presence of manganese in the amount specified addresses this problem and frees the invention from potentially hazardous iron sulfide films.

The steel alloy of this invention preferably contains from 0.15 to 0.35 weight percent silicon. The silicon is present as a deoxidant which will promote the recovery of subsequent aluminum, calcium or rare earth additions. Silicon also contributes to temper resistance and, consequently, improves the fire resistance of the cylinder. Further, silicon is one of the elements which contributes to hardenability. A silicon content below 0.15 weight percent will not be sufficient to achieve good recovery of subsequent additions. A silicon content greater than 0.35 weight percent will not result in a further reduction in oxygen content to any great extent.

The steel alloy of this invention preferably contains from 0.8 to 1.1 weight percent chromium. The chromium is present to increase the hardenability of the steel. It also contributes to temper resistance which is important for fire resistance. A chromium content below 0.8 weight percent in combination with the other specified elements and amounts of the invention will not be sufficient to provide adequate hardenability. At a chromium concentration greater than 1.1 weight percent, the effectiveness of the chromium in further increasing hardenability is significantly reduced.

The steel alloy of this invention preferably contains from 0.15 to 0.25 weight percent molybdenum. Molybdenum is an extremely potent element for increasing hardenability and it also enhances temper resistance and high temperature strength. Molybdenum is particularly effective in this capacity in combination with chromium, and the defined range for molybdenum corresponds to the amounts of molybdenum which are particularly effective with the specified chromium concentration range.

The steel alloy of this invention preferably contains from 0.005 to 0.05, most preferably from 0.01 to 0.03 weight percent aluminum. Aluminum is present as a deoxidant and for its beneficial effect on inclusion chemistry. An aluminum content below 0.005 weight percent may not be sufficient to produce a dissolved oxygen content of less than about 20 parts per million (ppm), which is desired in order to minimize the formation of oxide inclusions during solidification. Furthermore, an aluminum content below 0.005 weight percent will not be sufficient to prevent the formation of silicate type oxide inclusions which are plastic and would reduce fracture toughness in the important transverse direction. An aluminum content greater than 0.05 weight percent could result in dirtier steel containing alumina galaxy stringers.

The steel alloy of this invention preferably contains from 0.04 to 0.10 weight percent, most preferably from 0.07 to 0.10 weight percent vanadium. Vanadium is present because of its strong nitride and carbide forming tendency which promotes secondary hardening and is the principle reason for the increased temper resistance of the invention, which is clearly shown in FIG. 2. A vanadium content below 0.04 weight percent in combination with the other specified elements and amounts of the invention will not be sufficient to achieve the desired increase in temper resistance. However, because high vanadium levels tend to decrease hardenability, a vanadium content greater than 0.10 weight percent would not be desirable and is not required as far as temper resistance is concerned. The carbon and manganese concentrations of this invention are specified to compensate for any possible hardenability decrease caused by the specified vanadium presence.

The steel alloy of this invention contains not more than 0.040 weight percent, preferably not more than 0.025 weight percent phosphorus. A phosphorus concentration greater than 0.040 weight percent will increase the likelihood of grain boundary embrittlement and consequently a loss in toughness.

The steel alloy of this invention contains not more than 0.015 weight percent sulfur, preferably not more than 0.010 weight percent. The presence of more than 0.015 weight percent sulfur will dramatically reduce fracture toughness, particularly in the transverse and short-transverse orientations. Since the highest cylinder stress is the hoop stress, it is imperative that fracture toughness in the transverse orientation be maximized. Limiting the sulfur content to not more than 0.015 weight percent, especially in conjunction with calcium or rare earth shape control, provides the requisite transverse fracture toughness of at least 70 ksi square root inch, preferably 85 ksi square root inch, to achieve leak-before-break behavior at the 150 to 175 ksi tensile strength range.

The steel alloy of this invention preferably contains calcium in a concentration of from 0.8 to 3 times the concentration of sulfur. Sulfur has a detrimental effect on transverse orientation fracture toughness because of the presence of elongated manganese sulfide inclusions. The presence of calcium in an amount essentially equal to that of sulfur results in the sulfur being present in the form of spherical oxy-sulfide inclusions rather than elongated manganese sulfide inclusions. This dramatically improves transverse fracture toughness. The presence of calcium also results in the formation of spherical shape controlled oxide inclusions rather than alumina galaxy stringers. This leads to a further improvement in transverse fracture toughness. Calcium also improves the fluidity of the steel which can reduce reoxidation, improve steel cleanliness, and increase the efficiency of steel production.

The inclusion shape control achievable by the presence of calcium may also be obtained by the presence of rare earths or zirconium. When rare earths, such as lanthanum, cerium, praseodymium, neodymium, and the like are employed for such inclusion shape control, they are present in an amount of from 2 to 4 times the amount of sulfur present.

The steel alloy of this invention preferably contains not more than 0.012 weight percent nitrogen. A nitrogen concentration greater than 0.012 weight percent can reduce fracture toughness, result in an intergranular fracture mode and lead to reduced hot workability.

The steel alloy of this invention preferably contains not more than 0.010 weight percent oxygen. Oxygen in steel is present as oxide inclusions. An oxygen concentration greater than 0.010 weight percent will result in an excessive number of inclusions which reduce the toughness of the steel and reduce its microcleanliness.

The steel alloy of this invention preferably contains not more than 0.20 weight percent copper. A copper concentration greater than 0.20 weight percent has a deleterious effect on hot workability and increases the likelihood of hot tears which can result in premature fatigue failure.

Other normal steel impurities which may be present in small amounts are lead, bismuth, tin, arsenic, antimony, zinc, and the like.

Gas storage cylinders are fabricated from the steel alloy of this invention in any effective manner known to the art. Those skilled in the art of gas storage cylinder fabrication are familiar with such techniques and no further description of cylinder fabrication is necessary here.

One often used cylinder fabrication method involves the drawing of the cylinder shell. This technique, although very effective both commercially and technically, tends to elongate any defect in the axial direction of the cylinder. Since the major material stresses in loaded cylinders are the hoop stresses on the cylinder wall, any such axially elongated defects would be oriented transverse to the major cylinder load thereby maximizing its detrimental effect on cylinder integrity. It has been found that the high strength steel alloy of this invention exhibits surprisingly uniform directional strength and ductility, and excellent transverse toughness, i.e., that the steel has surprisingly low anisotropy. This low anisotropy effectively counteracts any loss of structural integrity caused by elongation of defects. This quality of the steel alloy of this invention further enhances its unique suitability as a material for gas storage cylinder construction.

Figure 2:
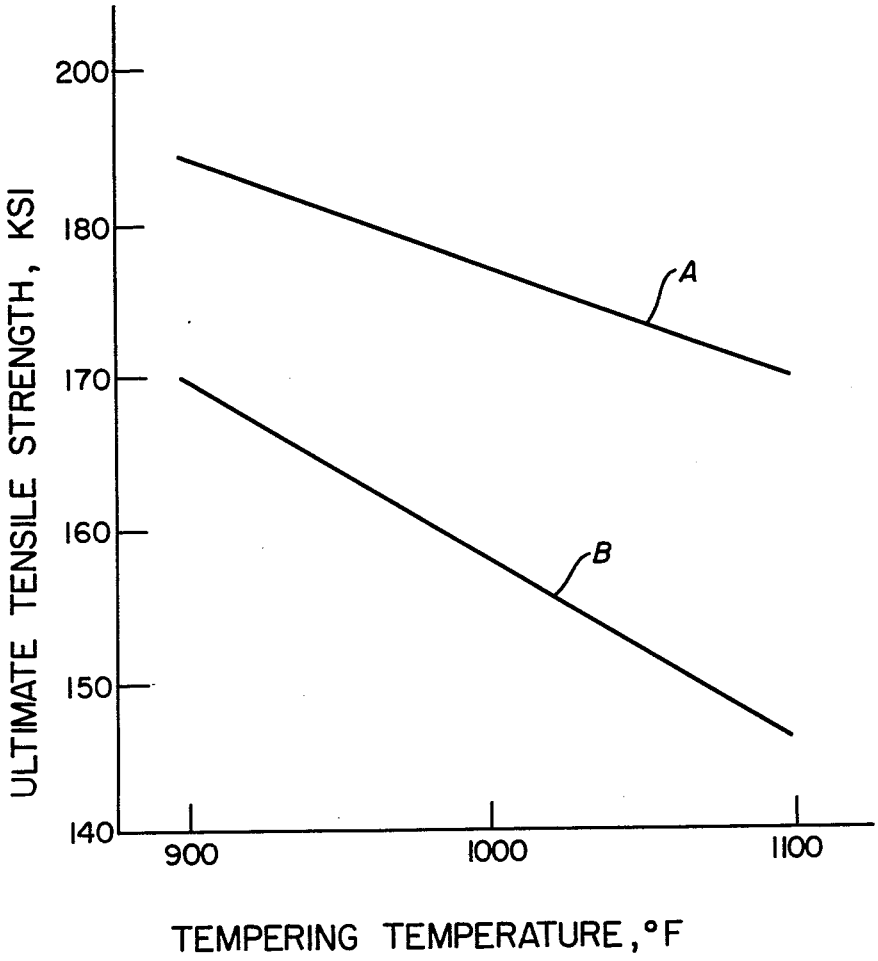
FIG. 2 is a graphical representation of the room temperature ultimate tensile strength as a function of tempering temperature for gas storage cylinders of this invention and of gas storage cylinders manufactured of 4130X in accord with Specification 3AA.
Figure 3:
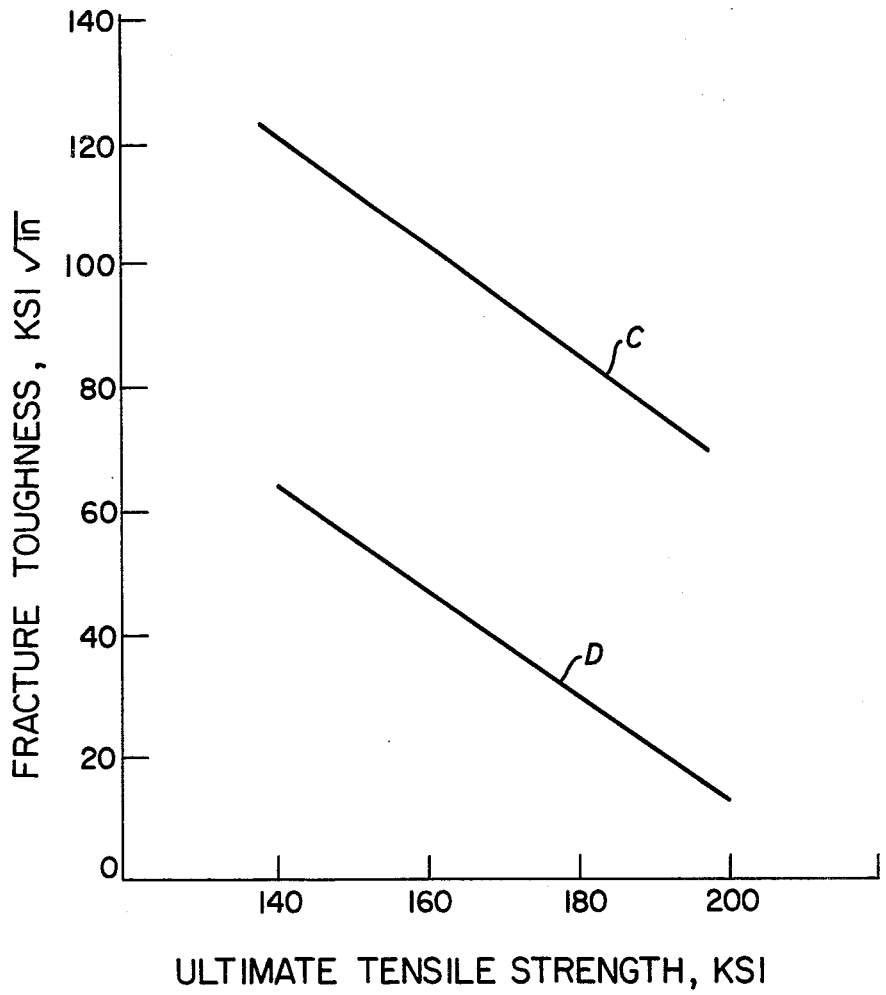
FIG. 3 is a graphical representation of the room temperature fracture toughness as a function of room temperature ultimate tensile strength for gas storage cylinders of this invention and of gas storage cylinders manufactured of 4130X in accord with Specification 3AA.
Figure 4:
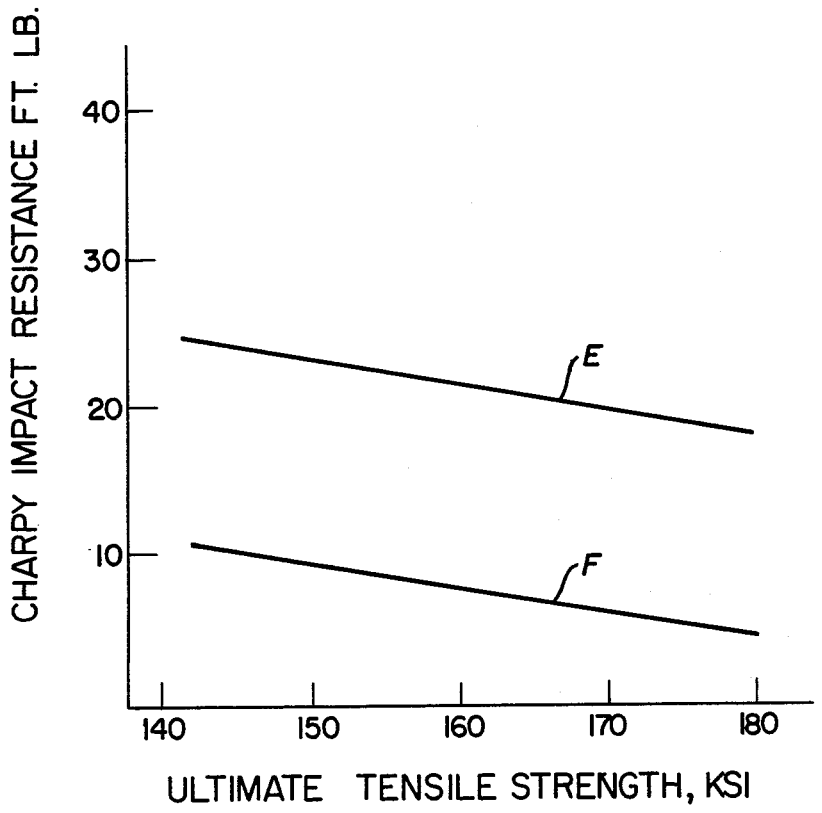
FIG. 4 is a graphical representation of room temperature Charpy impact resistance as a function of room temperature ultimate tensile strength for gas storage cylinders of this invention and of gas storage cylinders manufactured of 4130X in accord with Specification 3AA.

For a more detailed demonstration of the advantages of the cylinders of this invention over conventional cylinders, reference is made to FIGS. 2, 3 and 4 which compare material properties of the invention with that of conventional cylinders. In FIGS. 2, 3 and 4 the lines A–F are best fit curves for data from a number of cylinder tests. Any individual cylinder may have a particular material property somewhat above or below the appropriate line.

Referring now to FIG. 2, Line A represents the room temperature ultimate tensile strength of the steel alloy of this invention as a function of tempering temperature and Line B represents the room temperature ultimate tensile strength as a function of tempering temperature of 4130X. Ultimate tensile strength is important because the greater is the ultimate tensile strength of a material and corresponding design stress level the less material is necessary for a given cylinder design. This decrease in material usage is not only per se economically advantageous, but also the decreased weight leads to greatly improved cylinder efficiency. As can be seen from FIG. 2, for a given heat treatment the ultimate tensile strength of the steel alloy of this invention is significantly greater than that of 4130X, which, as has been mentioned before, is the usual material heretofore used in fabrication of gas storage cylinders. The improved tensile strength for the steel alloy of this invention is available along with acceptable fracture toughness, as will be shown in FIG. 3. This is not the case for 4130X which has unacceptably low fracture toughness at higher tensile strengths. Furthermore, because the relationship of ultimate tensile strength to tempering temperature for the steel alloy of this invention has a lower slope than that for 4130X, one can employ a broader tempering temperature range to get to the desired ultimate tensile strength range for the steel alloy of this invention, thus giving one greater manufacturing flexibility.

FIG. 2 serves to demonstrate another advantage of the steel alloy of this invention. As can be seen, the ultimate tensile strength of this invention when tempered at about 1100° F. is about the same as the ultimate tensile strength of 4130X when tempered at only about 900° F. Since the steel alloy of this invention can be heat treated to a given strength at a higher tempering temperature than that for 4130X, the steel alloy of this invention has greater strength at elevated temperature, and therefore has far better fire resistance than 4130X. This quality further enhances the specific suitability of the steel alloy of this invention as a material for gas storage cylinder construction.

The improved fire resistance of the steel alloy of this invention over that of 4130X is further demonstrated with reference to Table I which tabulates the results of tests conducted on 4130X tempered at about 900° F. and the steel alloy of this invention tempered at about 1075° F. Bars of each steel having a nominal cross section of 0.190×0.375 inches were induction heated at the indicated temperature for 15 minutes and then the tensile strength of each bar was measured using Instron servo-hydraulic test equipment. The results for the steel alloy of this invention (Column A) and for 4130X (Column B) are shown in Table I. As can be seen, the steel alloy of this invention has significantly improved fire resistance over that of 4130X.

TABLE I

| Temperature °F. | Tensile Strength-A (ksi) | Tensile Strength-B (ksi) | Increase (%) |
|---|---|---|---|
| 1000 | 116.3 | 101.5 | 15 |
| 1100 | 90.2 | 68.0 | 33 |
| 1200 | 58.1 | 52.8 | 10 |
| 1400 | 30.6 | 27.4 | 12 |

Referring now to FIG. 3, Line C represents the room temperature transverse fracture toughness of the steel alloy of this invention as a function of room temperature ultimate tensile strength and Line D represents the room temperature transverse fracture toughness as a function of room temperature ultimate tensile strength of 4130X. Fracture toughness is an important parameter because it is a measure of the ability of a cylinder to retain its structural integrity in spite of flaws present and possibly made worse during fabrication and of nicks, dents and arc burns encountered during service. As can be seen from FIG. 3, the transverse fracture toughness of the steel alloy of this invention is significantly greater than that of 4130X.

Fracture toughness is an important parameter for another reason. It is desirable for pressure vessels to exhibit leak-before-failure behavior. That is, if a pressure vessel should fail, it should fail in a gradual fashion so that the pressurized contents of the vessel can escape harmlessly, as opposed to a sudden catastrophic failure which can be extremely dangerous. In a cylinder any small flaw in the shell, whether originally present or inflicted during service, will grow as the cylinder is repeatedly recharged and eventually this cyclical loading of the cylinder wall will cause the flaw or crack to reach a critical size that will cause the cylinder to fail under applied load. Such flaws may also grow because of exposure to corrosion inducing environments while under pressure. The generally accepted standard for leak-before-break behavior is that the cylinder must maintain its structural integrity in the presence of a through-the-wall flaw of a length at least equal to twice the wall thickness. The fracture toughness of a material determines the relationship between the applied stress levels and the critical flaw sizes. The steel alloy of this invention has a fracture toughness of at least 70 ksi square root inch, preferably 85 ksi square root inch at an ultimate tensile strength of at least 150 ksi. The steel alloy of this invention having improved fracture toughness compared to that of the conventional cylinder fabrication material is able to maintain leak-before-break behavior for larger flaws and higher stresses than can the conventional material. This capability is a further indication of the specific suitability of the steel alloy of this invention as a material for gas storage cylinder construction.

Another way to demonstrate the increased toughness of the steel alloy of this invention over that of 4130X is by its Charpy impact resistance. Such data is shown in graphical form in FIG. 4. Referring now to FIG. 4, Line E represents the Charpy impact resistance at room temperature of the steel alloy of this invention as a function of ultimate tensile strength and Line F represents the Charpy impact resistance at room temperature as a function of ultimate tensile strength of 4130X. As can be seen from FIG. 4, the Charpy impact resistance of the steel alloy of this invention is significantly greater than that of 4130X.

Table II tabulates and compares parameters of the cylinder of this invention (Column A) and a comparably sized cylinder conforming to Specification 3AA (Column B) when oxygen is the gas to be stored. The oxygen volume is calculated at 70° F. and atmospheric pressure.

TABLE II

| | A | B |
|---|---|---|
| Maximum Gas Pressure (psig) | 3000 | 2640 |
| $O_2$ Gas Capacity | | |
| ($Ft^3$) | 380 | 330 |
| (Pounds) | 31.57 | 27.3 |
| Cylinder | | |
| Internal Diameter (inches) | 8.75 | 8.75 |
| Wall Thickness (inches) | 0.201 | 0.290 |
| Height (inches) | 55 | 55 |
| Weight (pounds) | 112 | 145 |
| Maximum Service Stress (ksi) | 68.0 | 44.2 |
| Maximum Ultimate Tensile Strength (ksi) | 150 | 105 |
| Efficiency ($FT^3O_2$/lb.cyl.) | 3.39 | 2.28 |

As can be seen from Table II, the gas storage cylinder of this invention is a significant improvement over present conventional cylinders. In particular, the gas storage cylinder of this invention exhibits a cylinder efficiency of about 3.4 compared to 2.3 of the conventional cylinder. This is a performance improvement of about 48 percent.

The steel alloy of this invention is extremely well suited for use in the fabrication of gas storage cylinders intended to store gases other than hydrogen gearing gases, i.e., hydrogen, hydrogen sulfide, etc. By such use one can now produce a far more efficient cylinder than was heretofore possible. The steel alloy and gas cylinder manufactured thereof of this invention simultaneously exhibit significantly better fracture toughness at higher ultimate tensile strengths and also improved fire resistance than any heretofore known steel alloy. This combination of qualities is uniquely well suited for gas storage cylinders.

We claim:

1. In a gas storage cylinder enclosed at one end and exhibiting leak-before-break behavior, the improvement, whereby increased cylinder efficiency, ultimate tensile strength, fracture toughness and fire resistance are attained, comprising a cylinder shell of a low alloy steel consisting essentially of:

(a) from 0.28 to 0.50 weight percent carbon;
(b) from 0.6 to 0.9 weight percent manganese;
(c) from 0.15 to 0.35 weight percent silicon;
(d) from 0.8 to 1.1 weight percent chromium;
(e) from 0.15 to 0.25 weight percent molybdenum
(f) from 0.005 to 0.05 weight percent aluminum;
(g) from 0.04 to 0.10 weight percent vanadium;
(h) not more than 0.040 weight percent phosphorus;
(i) not more than 0.015 weight percent sulfur;
(j) calcium in a concentration of from 0.8 to 3 times the concentration of sulfur, or rare earth element(s) in a concentration of from 2 to 4 times the concentration of sulfur; and
(k) the remainder of iron.

2. The steel alloy of claim 1 containing from 0.30 to 0.42 weight percent carbon.

3. The steel alloy of claim 1 containing from 0.32 to 0.36 weight percent carbon.

4. The steel alloy of claim 1 containing 0.01 to 0.03 weight percent aluminum.

5. The steel alloy of claim 1 containing from 0.07 to 0.010 weight percent vanadium.

6. The steel alloy of claim 1 containing not more than 0.025 weight percent phosphorus.

7. The steel alloy of claim 1 containing not more than 0.012 weight percent nitrogen.

8. The steel alloy of claim 1 containing not more than 0.010 weight percent oxygen;

9. The steel alloy of claim 1 containing not more than 0.20 weight percent copper.

10. The steel alloy of claim 1 having an ultimate tensile strength of at least 150 thousands of pounds per square inch and a fracture toughness of at least 70 ksi square root inch.

11. The steel alloy of claim 1 containing not more than 0.010 weight percent sulfur.

* * * * *

UNITED STATES PATENT AND TRADEMARK OFFICE

CERTIFICATE OF CORRECTION

PATENT NO. : 4,461,657

DATED : July 24, 1984

INVENTOR(S) : M.D. Rana et al

It is certified that error appears in the above-identified patent and that said Letters Patent is hereby corrected as shown below:

In column 10, line 55 delete "gearing" and substitute therefor --bearing--.

Signed and Sealed this

*Twenty-third* Day of *October 1984*

[SEAL]

*Attest:*

GERALD J. MOSSINGHOFF

*Attesting Officer*

*Commissioner of Patents and Trademarks*